US007593660B2

(12) United States Patent
Junichi

(10) Patent No.: US 7,593,660 B2
(45) Date of Patent: Sep. 22, 2009

(54) IMAGE FORMING APPARATUS AND IMAGE FORMING SYSTEM

(75) Inventor: Iida Junichi, Kawasaki (JP)

(73) Assignee: Ricoh, Ltd., Tokyo (JP)

( * ) Notice: Subject to any disclaimer, the term of this patent is extended or adjusted under 35 U.S.C. 154(b) by 191 days.

(21) Appl. No.: 11/896,557

(22) Filed: Sep. 4, 2007

(65) Prior Publication Data

US 2008/0063422 A1 Mar. 13, 2008

(30) Foreign Application Priority Data

Sep. 5, 2006 (JP) ..... 2006-240700
Jun. 26, 2007 (JP) ..... 2007-167829

(51) Int. Cl.
*G03G 15/00* (2006.01)

(52) U.S. Cl. ..... 399/75; 399/76; 399/81

(58) Field of Classification Search ..... 399/9, 399/12, 13, 75, 76, 81
See application file for complete search history.

(56) References Cited

U.S. PATENT DOCUMENTS

| | | | | |
|---|---|---|---|---|
| 6,975,818 | B2 * | 12/2005 | Lee | 399/75 |
| 2005/0206071 | A1 | 9/2005 | Suzuki et al. | |
| 2005/0218579 | A1 | 10/2005 | Yamada et al. | |
| 2005/0225021 | A1 | 10/2005 | Yamada et al. | |
| 2006/0022394 | A1 | 2/2006 | Tamura et al. | |
| 2006/0120783 | A1 | 6/2006 | Tokita et al. | |
| 2006/0120784 | A1 | 6/2006 | Iida et al. | |
| 2007/0029716 | A1 | 2/2007 | Yamada et al. | |
| 2007/0035079 | A1 | 2/2007 | Yamada et al. | |
| 2007/0035080 | A1 | 2/2007 | Yamada et al. | |
| 2007/0052147 | A1 | 3/2007 | Tamura et al. | |
| 2007/0056423 | A1 | 3/2007 | Yamada et al. | |

FOREIGN PATENT DOCUMENTS

| | | |
|---|---|---|
| JP | 08-220945 | 8/1996 |
| JP | 11-015772 | 1/1999 |
| JP | 11-017712 | 1/1999 |
| JP | 2001-209275 | 8/2001 |
| JP | 2004-214812 | 7/2004 |
| JP | 2004-310747 | 11/2004 |
| JP | 2005-063050 | 3/2005 |

* cited by examiner

*Primary Examiner*—Hoan H Tran
(74) *Attorney, Agent, or Firm*—Harness, Dickey & Pierce, P.L.C.

(57) ABSTRACT

An image forming system which makes clear the point in time at which initial information transmission for all peripheral devices connected to an image forming apparatus serving as the main device is complete, even when the peripheral devices are attached in various combinations, to thereby reduce the time until it is possible for a user to start operation to the lowest level possible, and to reduce waiting time for powering on. The image forming system such as a copying machine includes at least one peripheral device which can be serially connected to a main body of the copying machine, and communication means for performing communication with the most upstream peripheral device of the peripheral devices. When turned on or reset, the image forming system displays functions of the peripheral devices on an operating unit based on initial information delivered from the peripheral devices. Also, upon receiving initial information and initial information transmission completion information from the most upstream peripheral device, the image forming system starts display of functions of the system on the operating unit based on the initial information received up until that time.

9 Claims, 9 Drawing Sheets

IMAGE FORMING APPARATUS AND IMAGE FORMING SYSTEM

BACKGROUND OF THE INVENTION

1. Field of the Invention

The present invention relates to an image forming apparatus, which communicates with a peripheral device such as a finisher, a paper feeder, or an ADF (Automatic Document Feeder), and is capable of acquiring information regarding such device, and also relates to an image forming system in which at least one of such peripheral devices is attached to the image forming apparatus.

2. Description of the Related Art

In recent years, devices positioned on the downstream side of copying machines, printers and other such image forming apparatuses, such as devices for hole punching or binding recording paper to be output, inserters for inserting cover-sheets and interleaves, devices for stacking large amounts of paper, bookbinding machines for binding, folding machines for folding operations and other such finishers or paper feeders for supplying large amounts of paper, are widely known and used. These days there is demand for a copying machine, which can be connected to devices having various functions, and which by using the functions of such devices can perform various operations. Furthermore, there is demand for enabling such functions to be selected on the users' side. On the other hand, as copying machines are set to automatically turn off when not in use to reduce energy usage and minimize environmental impact, to improve usability of this feature, there is also demand for the reduction of the waiting time from when the copying machine is turned on until the time when a user can start using.

An invention disclosed in Japanese Patent Publication No. 337957, for example, is well known as a technology addressing these kinds of demands. This invention is a network system which includes document transport means, image forming means and paper feeding means, and which is connected to a plurality of image forming apparatuses via communication means for communicating motion commands, status, image information and the like. This network system is characterized in that when a plurality of image forming apparatuses are made to share and perform one printing operation, an image forming apparatus which an operator operates, issues resource use requests to other image forming apparatuses which are to share the printing operation. In response to this use request these other image forming apparatuses determine whether or not to grant resource use, and issue resource use permission to the image forming apparatus operated by the operator. The network system also comprises means for when a malfunction occurs in a specific image forming apparatus, which stops the operation of the image forming apparatus in which the malfunction has occurred, while continuing operation of all other normally operating image forming apparatuses without modification. The network system also further comprises means for when a malfunction occurs in an image forming apparatus other than the image forming apparatus operated by the operator, which outputs a warning to the image forming apparatus operated by the operator, stating that a malfunction has occurred and specifying the image forming apparatus in which the malfunction occurred.

Conventionally, resource use demands, resource use permission, and occurrences of malfunctions are handled in the manner disclosed in the patent publication described above. However, initial information is given no particular consideration. In other words, in the conventional technology, as the completion of transmission of initial information is unknown, displaying on the operating unit starts after an amount of time has passed in which it is thought that the initial information has been completely transmitted. In this manner, conventionally displaying on the operating unit starts at an estimated time, and as such for a period of time no functions are displayed on the operating unit. This results in a large period of waiting time until a user can start using. If for a period of time no functions are displayed on the operating unit, when there are numerous devices attached to the image forming apparatus, as the amount of initial information increases and due to the individual connection time for each device, this results in an even longer waiting time.

Technologies relating to the present invention are also disclosed in, e.g., Japanese Patent Publication No. 3397763, Japanese Patent Application Laid-open No. 2004-214812, Japanese Patent Application Laid-open No. 2005-063050, Japanese Patent Application Laid-open No. H11-015772, and Japanese Patent Application Laid-open No. H11-017712.

SUMMARY OF THE INVENTION

An object of the present invention is to make clear the point in time at which initial information transmission for all peripheral devices, such as a finisher or a paper feeder, which are connected to an image forming apparatus serving as the main device, is complete, even when a plurality of devices are attached in various combinations, to reduce the time until it is possible for a user to start operation to the lowest level possible, and to reduce waiting time for powering on.

In an aspect of the present invention, an image forming apparatus comprises at least one peripheral device that can be serially connected to a main body of the image forming apparatus, and a communication device for performing communication with the most upstream peripheral device of the peripheral devices, and which, when turned on or reset, displays functions of the peripheral devices on an operating unit based on initial information delivered from the peripheral devices. When initial information and initial information transmission completion information from the most upstream peripheral device is received, displaying of the functions on the operating unit is started based on the initial information received up until that time.

In another aspect of the present invention, an image forming system comprises an image forming apparatus; and a plurality of peripheral devices connected to the image forming apparatus. The image forming apparatus comprises at least one peripheral device that can be serially connected to a main body of the image forming apparatus, and a communication device for performing communication with the most upstream peripheral device of the peripheral devices, and when turned on or reset, displays functions of the peripheral devices on an operating unit based on initial information delivered from the peripheral devices, and when initial information and initial information transmission completion information from the most upstream peripheral device is received, starts display of the functions on the operating unit based on the initial information received up until that time.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
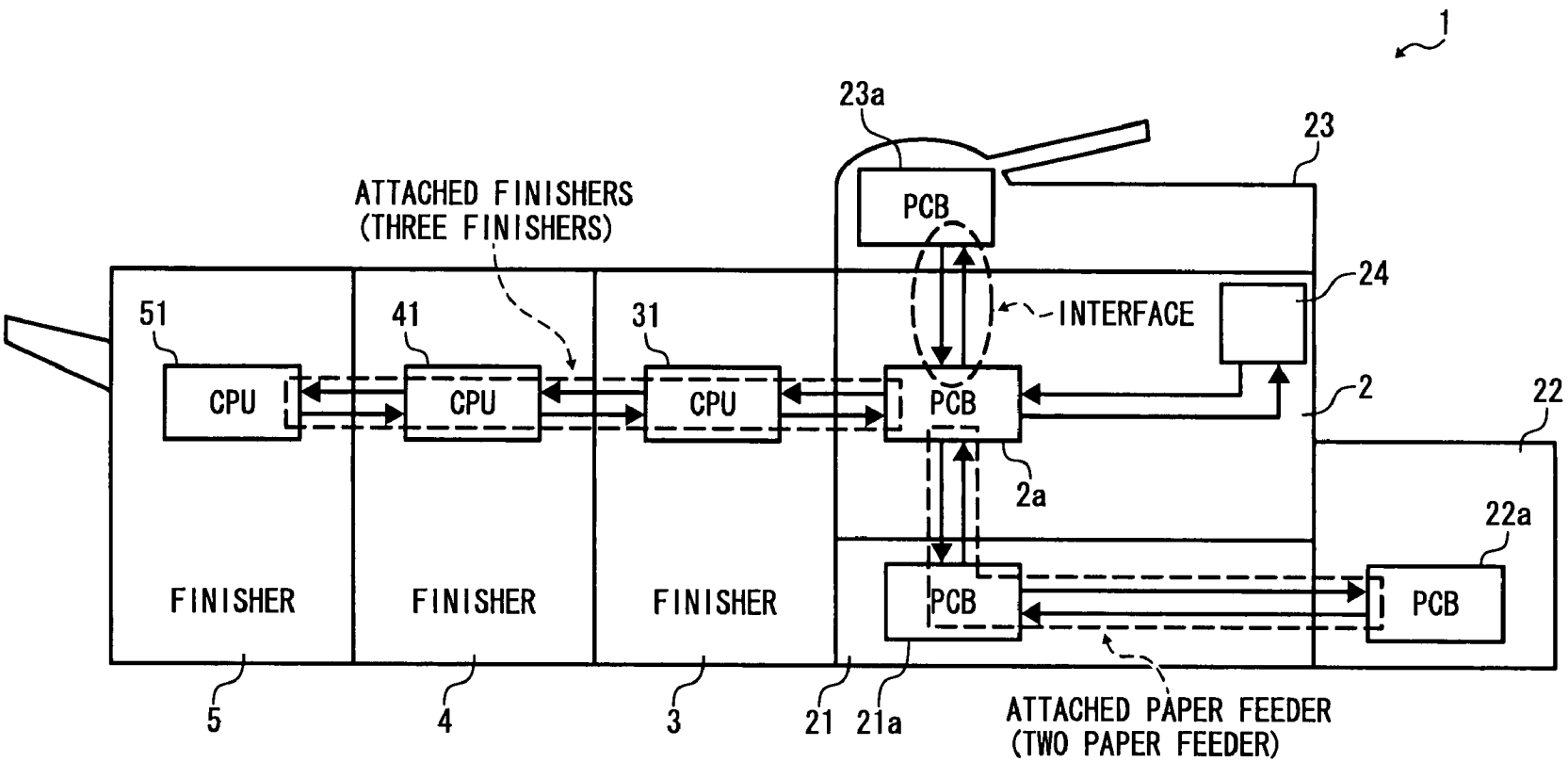
FIG. 1 shows a complete system configuration of an image forming apparatus according to an embodiment of the present invention and depicts an aspect in which a plurality of peripheral devices are attached to a main body of a copying machine.

Below embodiments of the present invention will be explained while referring to the drawings.

In FIG. 1 an image forming system according to the present embodiment is configured from a copying machine 2 as an image forming apparatus, three finishers 3, 4, 5, two paper feeders 21, 22 and one automatic document feeder (ADF) 23. The first through the third finishers 3, 4, 5 are serially attached to the copying machine 2. The first and the second feeders 21, 22 are attached to the main body of the copying machine 2, and the automatic document feeder (ADF) 23 is installed in the upper portion of the main body of the copying machine 2. Furthermore, an operating unit 24 is provided in the main body of the copying machine 2.

In each finisher 3, 4, 5 a CPU 31, 41, 51 is mounted. Also, PCBs (Printed Circuit Board) 2*a*, 21*a*, 22*a*, 23*a* mounted with CPUs are disposed respectively in the main body of the copying machine 2, the first and second feeders 21, 22 and the ADF 23. The CPUs 31, 41, 51 of the first through the third finishers 3, 4, 5 respectively are serially connected in this order to the PCB 2*a* in the main body of the copying machine 2. The PCBs 21*a*, 22*a* of the first and second feeders 21, 22 are serially connected in this order to the PCB 2*a* of the main body of the copying machine 2 also. The PCB 23*a* of the ADF 23 is also connected to the PCB 2*a* of the main body of the copying machine 2. Furthermore, the operating unit 24 is also connected to the PCB 2*a* of the main body of the copying machine 2, and along with transmitting operating input data to the PCB 2*a* side, the operating unit 24 also performs operation displaying according to display commands from the PCB 2*a*. Also, control (to be described later on) uses RAM (not shown in drawings) as a work area according to a program code stored in ROM (not shown in drawings) and is carried out by the CPUs 31, 41, 51 and the CPUs mounted on the PCBs 2*a*, 21*a*, 22*a*, 23*a*. Furthermore, control of the main body of the copying machine 2, and between the peripheral devices and the main body of the copying machine 2, is carried out by the CPU provided on the PCB 2*a* mounted in the main body of the copying machine 2. A configuration required for communication is provided on the PCBs 2*a*, 21*a*, 22*a*, 23*a* and PCBs (not shown in drawings) mounted with the CPUs 31, 41, 51 of each of the finishers.

Figure 2:
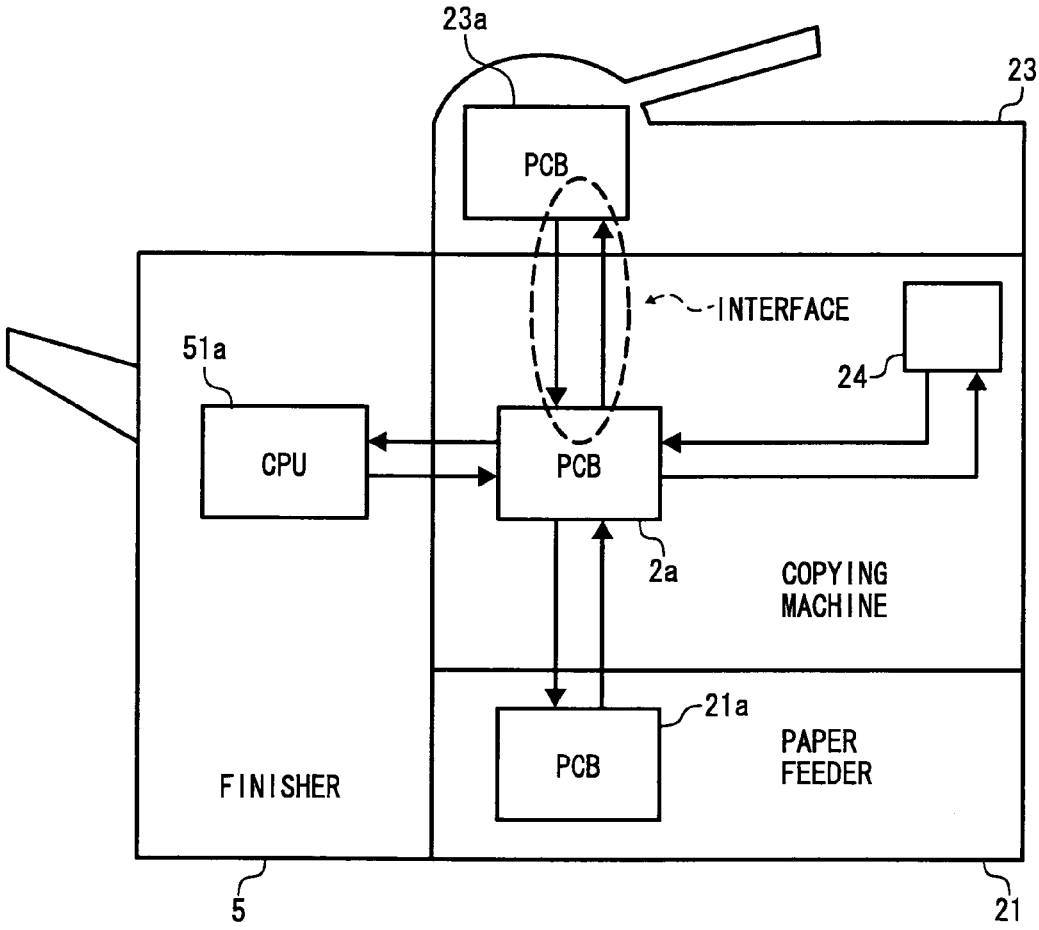
FIG. 2 shows the complete system configuration of the image forming apparatus according to the same embodiment as FIG. 1 and depicts an aspect in which no other peripheral device is attached on the downstream side of the peripheral device.

In a system configured in the above manner, when the main body of the copying machine 2 is turned on the first through third finishers 3, 4, 5 are supplied with power, and await the start of communication. After this, the copying machine 2 notifies the first finisher 3 that communication is possible, (FIG. 3: Step S101, FIG. 4: Step S201). Then the first finisher 3 begins delivery of initial information regarding itself to the copying machine 2, while also confirming whether or not there is a device connected on the downstream side (confirms the existence or non-existence of a finisher connected on the side separated from the copying machine 2 by itself) (FIG. 3: Step S102, Step S103). If here a connection to a finisher on the downstream side could not be confirmed, as shown in FIG. 2, this is identical to a connection state in which only the third finisher 5 is attached and there are no attachments to any other finishers.

Figure 4:
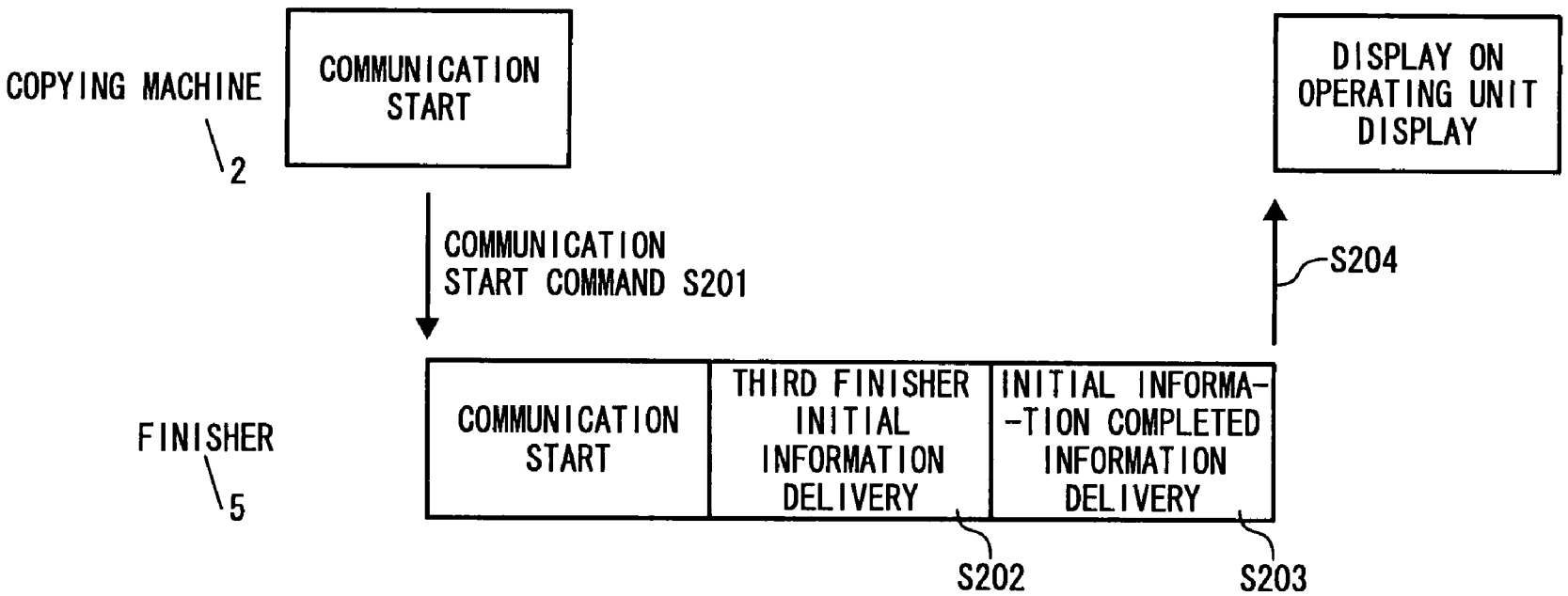
FIG. 4 shows a communication procedure for the system configuration shown in FIG. 2.

When in this manner a connection to a finisher on the downstream side cannot be confirmed, as FIG. 4 shows, the third finisher 5 determines that it is the most downstream connected device, and delivers initial information regarding itself to the copying machine 2 (Step S202). After the third finisher 5 confirms that this delivery is complete, the third finisher 5 sends initial information transmission completion information (hereinafter and in drawings referred to as "initial information completion information") to the copying machine 2 (Step S203, S204). Accordingly, recognition means are configured for the CPUs mounted in the peripheral devices such that a CPU recognizes a peripheral device is the most downstream device when connection of a finisher on the downstream side of the peripheral device cannot be confirmed.

Figure 5:
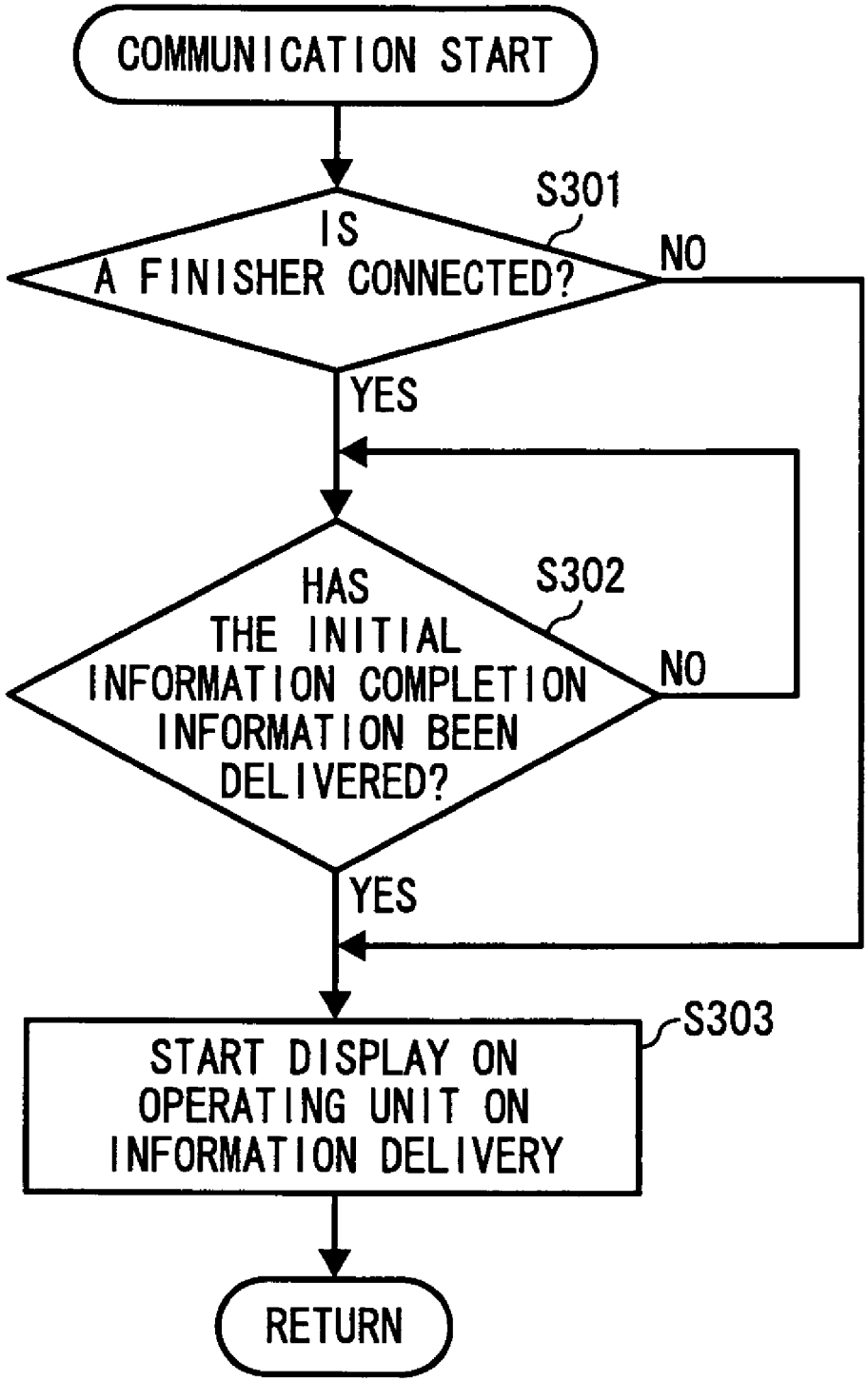
FIG. 5 is a flow chart showing an operating procedure of the copying machine for the system configurations shown in FIG. 1 and FIG. 2.
Figure 7A:
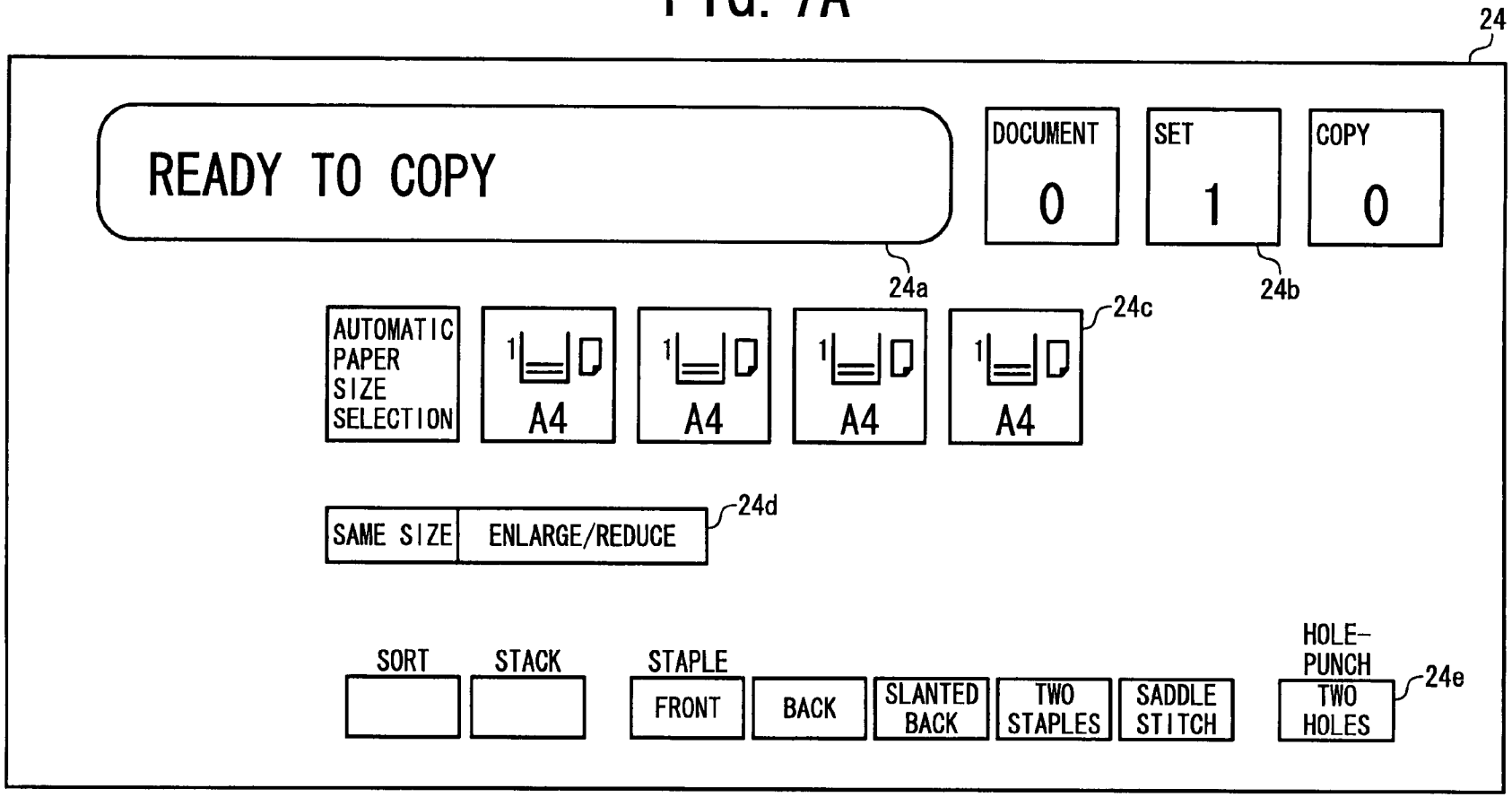
FIG. 7A shows a display screen of an operating unit and depicts a display status for when operation is normal.
Figure 7B:
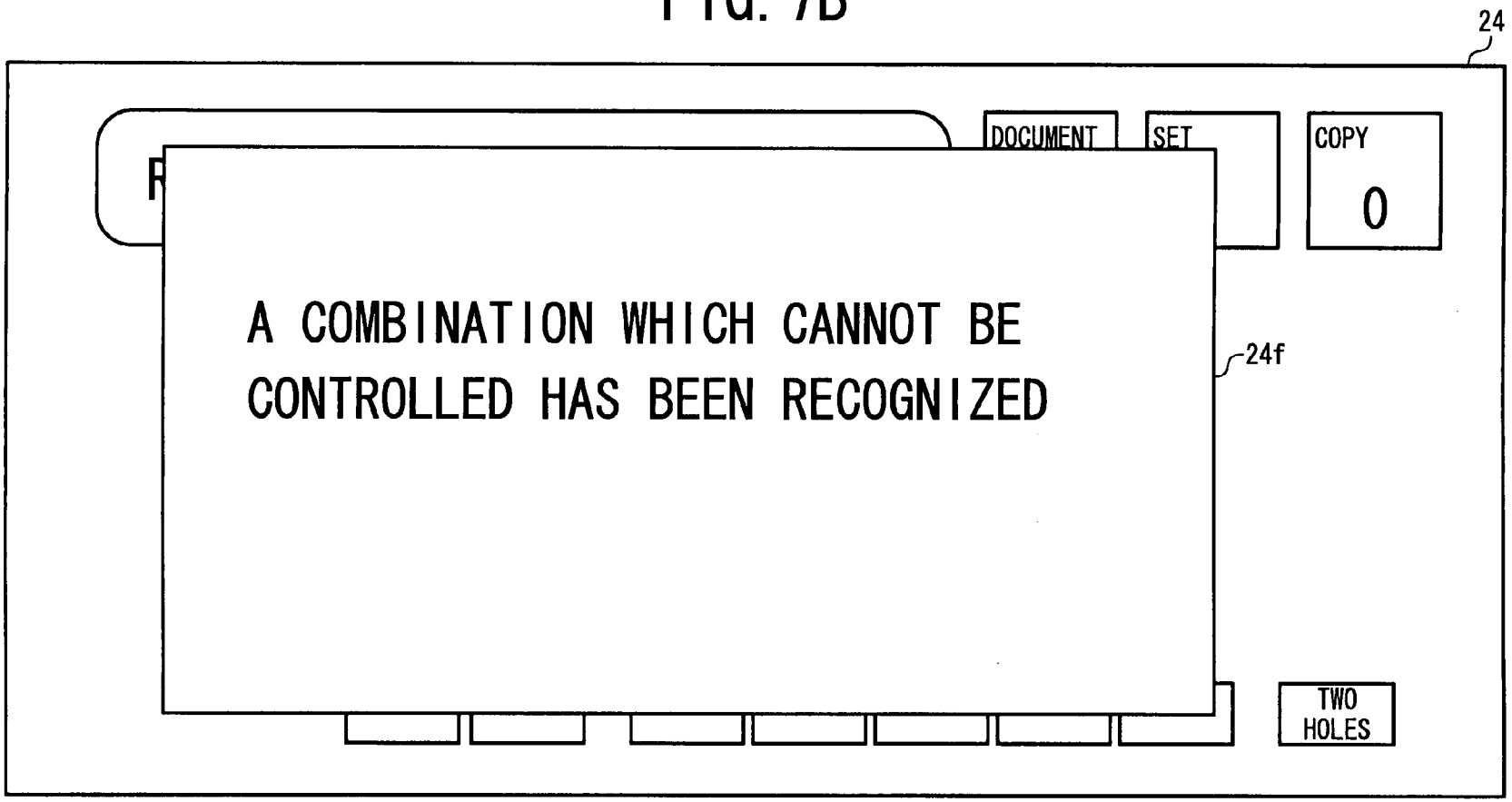
FIG. 7B shows the display screen of the operating unit and depicts a display status for when a malfunction occurs.

The copying machine 2 waits from the start of communication for initial information transmission completion information to be delivered from the first finisher 3 (FIG. 5: Step S301). When the initial information transmission completion information is sent from the first finisher 3 (FIG. 5: Step S302), if capable of displaying, the operating unit 24 starts displaying based on the initial information received up until that time (FIG. 5: Step S303). Examples of displays of the operating unit 24 are shown in FIG. 7A and FIG. 7B. FIG. 7A shows an example of a display when operation is normal. As understood from this figure, various portions such as a message display portion 24*a*, a number of page display portion 24*b*, a paper display selection portion 24*c*, an enlarging/reducing specification portion 24*d*, and a finisher selection portion 24*e* are set in the operating unit 24, and when printing or copying, selection of paper, number of pages to be output, condition setting, and finisher selection specification, is possible from the screen of the operating unit 24. Also, control relating to display of these various settings, start of display, display information and so on, is carried out by the CPU provided on the PCB 2*a*.

Figure 3:
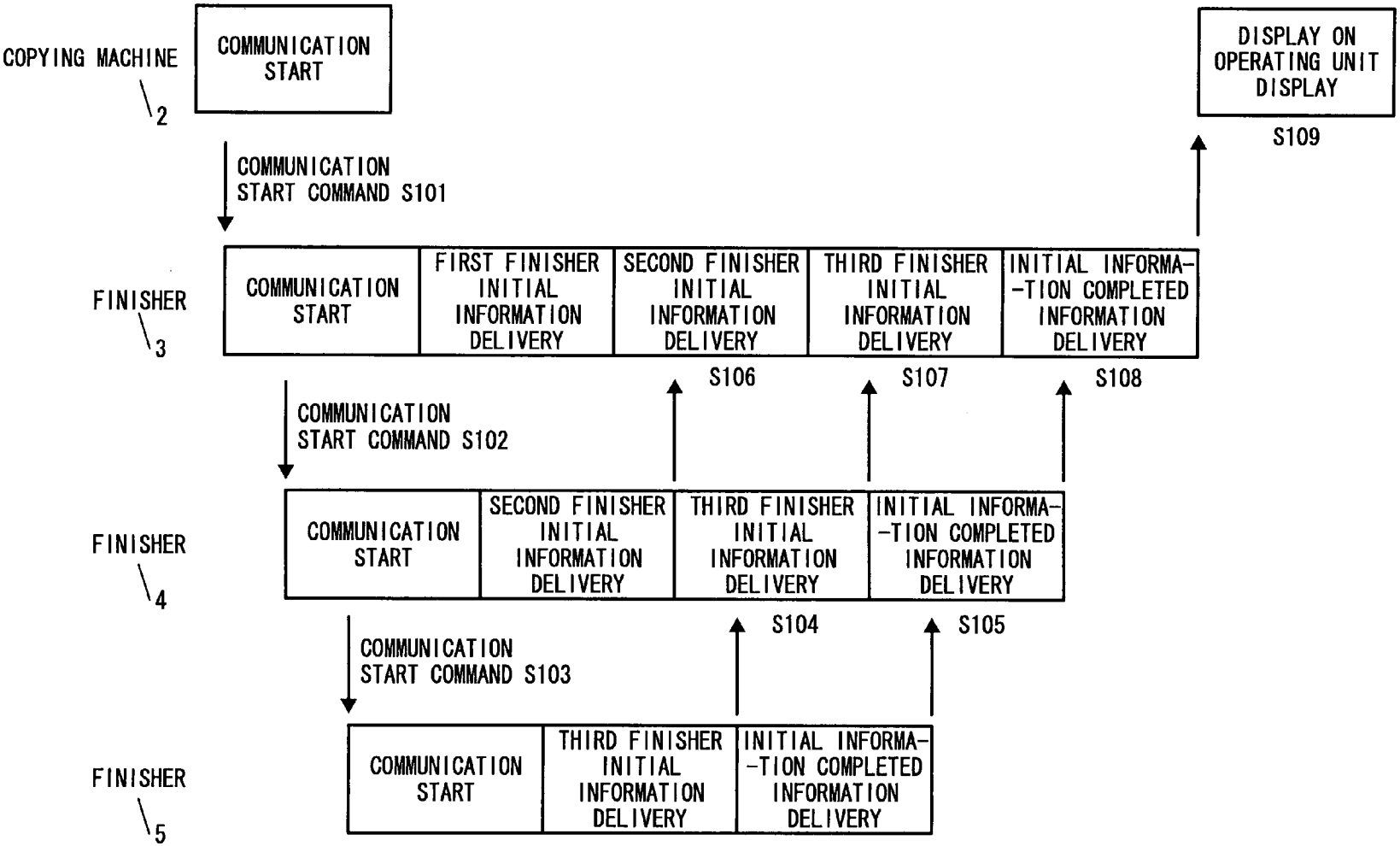
FIG. 3 shows a communication procedure for the system configuration shown in FIG. 1.

When the first finisher 3 makes confirmation that another finisher is connected downstream, in other words, when as FIG. 1 shows, a plurality of finishers are attached to the copying machine 2, a finisher delivers initial information delivered from an upstream device together with initial information regarding itself to the device downstream (FIG. 3: Step S102, S103), and also waits for initial information transmission completion information to be delivered from the downstream device. Furthermore, while initial information transmission completion information is being delivered from the downstream device (FIG. 3: finishers), the finisher delivers (FIG. 3: Step S104) initial information regarding itself to the upstream device (FIG. 3: the second finisher 4 to the first finisher 3, the third finisher 5 to the second finisher 4).

After the third finisher 5 completes delivery of initial information regarding itself, it transmits initial information transmission completion information (Step S105). When the second finisher 4 receives initial information transmission completion information from the downstream device (Step S105), the second finisher 4 confirms status of delivery of initial information regarding itself, and if the second finisher 4 has completed delivering initial information regarding itself and initial information received from an upstream device, the second finisher 4 transmits initial information transmission completion information to the upstream device (Step S108). If when initial information transmission completion information is delivered from the downstream device, the second finisher 2 has not completed sending initial information regarding itself to the upstream device, the second finisher 4 waits for completion of delivery of initial information regarding itself, and after delivery is completed, transmits initial information transmission completion information to the upstream device (Step S108). At this time it is essential that the initial information delivered from the downstream device be delivered in the order delivered from the downstream devices (Step S106, Step S107). Also, when the main body of the copying machine 2 is unable to confirm the existence of finishers, if the operating unit 24 is capable of displaying, displaying of this information on the operating unit 24 is quickly started. By performing control in this manner, it is possible to display the number of connected devices on the operating unit 24 in the shortest amount of time possible.

Figure 6:
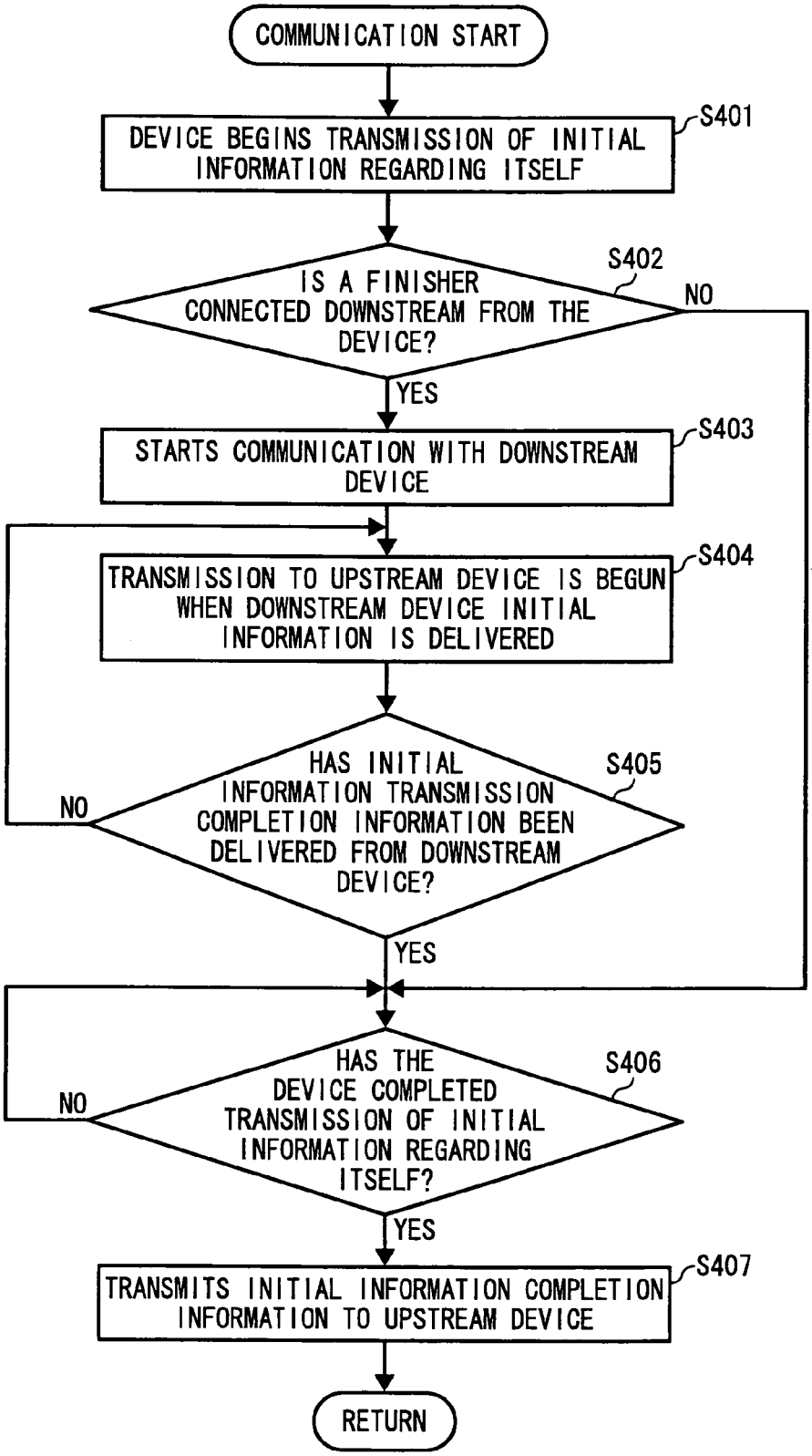
FIG. 6 is a flow chart showing an operating procedure of a finisher for the system configurations shown in FIG. 1 and FIG. 2.

FIG. 6 is a flow chart showing the control procedure of the finishers 3, 4, 5 at this time. A finisher first begins to transmit initial information regarding itself (Step S401, FIG. 3: Step S101, S102, S103), and then the finisher checks whether or not another finisher is connected downstream (Step S402). If another finisher is connected downstream from the finisher, (Step S402—YES), the finisher begins communication with the downstream device (Step S403) and when initial information regarding the downstream device is delivered, the finisher begins transmission of this initial information to an upstream device (Step S404, FIG. 3: S104, S106, S107). This operation continues until initial information transmission completion information is delivered from the downstream device (Step S405—NO). When the initial information transmission completion information is delivered from the downstream device (Step S405—YES, FIG. 3: Step S105, S108), the finisher confirms completion of transmission of initial information regarding itself (Step S406) and once transmission is completed, the finisher transmits initial information transmission completion information to the upstream device (Step S407, FIG. 3 Step S108, S109).

In the system configured in the manner shown in FIG. 1, there is at least a peripheral device which can be the most downstream device, and a peripheral device which cannot be the most downstream device. For example, the preceding may be a finisher, a trimmer (shearing device), a mailbox or such, and the later may be an inserter, a hole-puncher (hole punching device), a folding device or the like.

Consequently, when the system is configured, in a case in which the most downstream device is a device which cannot be the most downstream device, either there is a mistake in the system formation, or alternatively, a malfunction has occurred in the connection of a device on the downstream side of a device, causing such device to recognize itself as the most downstream device. These are both malfunctioning states in which the system cannot function. In order to solve this problem, in the present embodiment when the main body of the copying machine 2 is turned on, the first through the third finishers 3, 4, 5 are also supplied with power, and await the start of communication. Afterwards, the copying machine 2 notifies the first finisher 3 that communication is possible, and transmission processing is started. This transmission processing was explained above with reference to the previously described FIG. 2.

The CPU of the copying machine 2 waits from the start of communication for the initial information transmission completion information to be delivered from the first finisher 3. When the CPU of the copying machine 2 determines from the initial information and the initial information transmission completion information delivered, that the most downstream peripheral device is a peripheral device which cannot be the most downstream device, it switches the display of the operating unit 24. This switch is, for example, a switchover to a display which overlays the display during normal operation as shown in FIG. 7A with a message display 24*f* as shown in FIG. 7B of a service man call and a message reading "a combination which cannot be controlled has been recognized." In this manner it is clearly expressed that use as a system is impossible.

Figure 8:
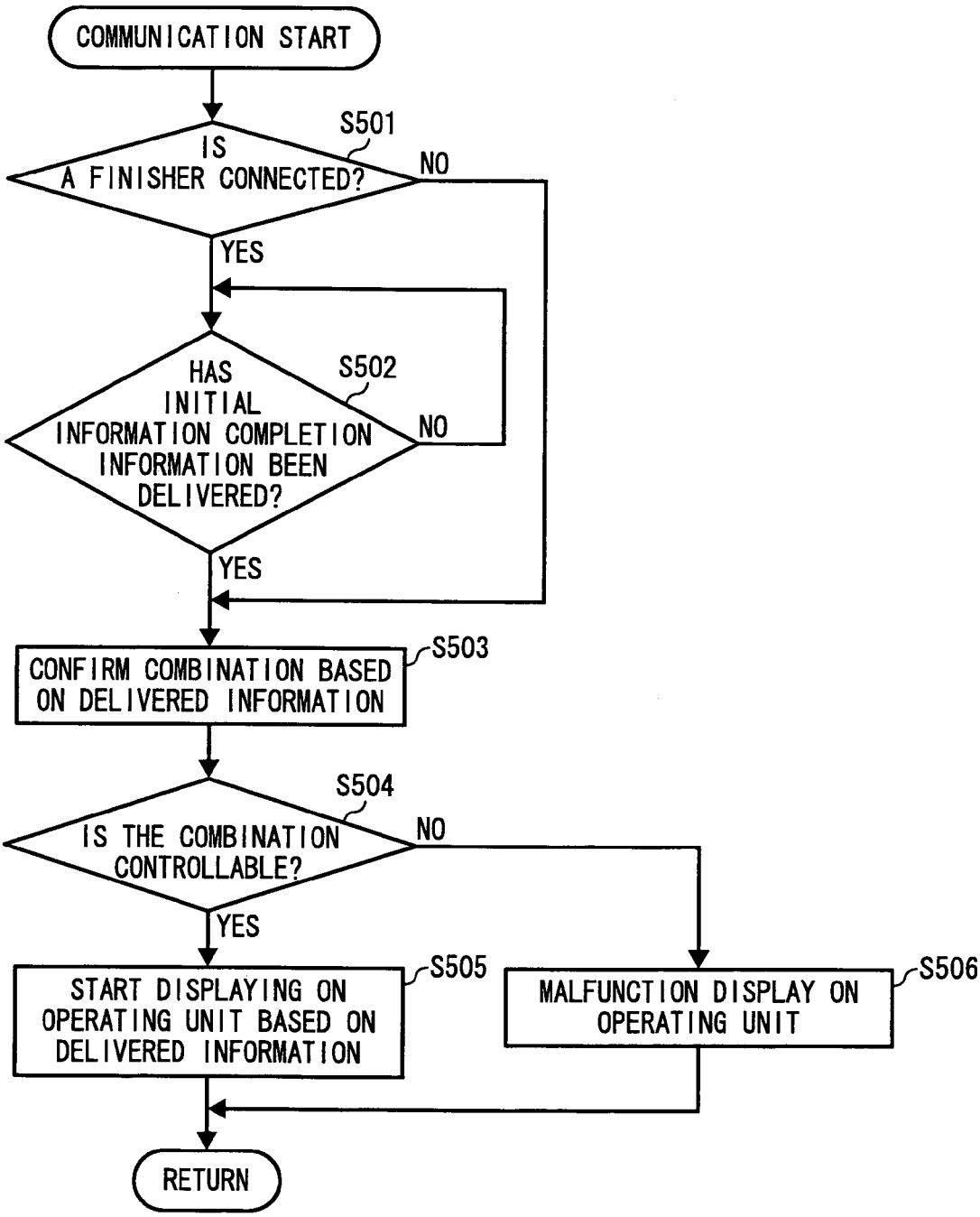
FIG. 8 is a flow chart showing an operating procedure for the main body of the copying machine when a malfunction is detected.

FIG. 8 is a flow chart showing the processing procedure at this time. The CPU of the copying machine 2 checks whether or not a finisher is connected (Step S501), and if there is a finisher connected (Step S501—YES), the CPU further checks whether or not initial information transmission completion information has been delivered (Step S502). When initial information transmission completion information is received (Step S502—YES), or alternatively when in Step S501 it is found that no finisher is connected, the CPU confirms the combination of the peripheral devices based on the delivered information (Step S503). Also, the CPU checks whether or not the confirmed combination is controllable (Step S504), and if it is determined that the combination is controllable (Step S504—YES), displaying on the operating unit 24 is started based on the delivered information (Step S505), and a display such as that shown in FIG. 7A is displayed. Conversely, if the CPU determines that the combination is not controllable (Step S504—NO), a malfunction display such as that shown in FIG. 7B is displayed on the operating unit 24 (Step S506).

Furthermore, when the CPU of the main body of the copying machine 2 does not receive the initial information transmission completion information corresponding to the initial information even after a time set in advance (timeout time) has passed since the initial information was first received, display of the system functions on the operating unit 24 can be started based on the information delivered up until that time. The timeout time for receiving of the initial information transmission completion information at this time may be arbitrarily set by a user by calling up a time setting screen (not shown in drawings) on the operating unit 24. As a result of this, for example, if the timeout time is determined according to the number of peripheral devices which may be attached to the copying machine 2, even if a situation in which the initial information transmission completion information cannot be sent occurs due to noise or such, failure of the operating unit 24 to start up can be prevented.

Please note that the present embodiment was explained using a finisher as an example, and in cases of an attachable paper feeder or ADF the same kind of control is possible.

The present embodiment has the following effects:

1) the initial information transmission completion of connected peripheral devices is known, and as based on this information the functions of the peripheral devices connected are displayed on an operating unit, even if a plurality of peripheral devices are variously combined, the operating unit can be started up in the least amount of time possible for that combination;

2) a timeout time for the receiving time for initial information transmission completion information, is determined by the number of devices that can be serially connected to a copying machine, and as such even if a situation occurs in which the initial information transmission completion information could not be sent due to noise or such, failure of the operating unit to start up can be prevented; and 3) the operating unit is started up in the least amount of time possible, and moreover even if a situation occurs in which the initial information transmission completion information cannot be sent, as failure of the operating unit to start up may be prevented, a system may be provided in which waiting time for powering on is reduced and which has good usability.

In conclusion, according to the present invention, as initial information transmission completion information indicating completion of initial information transmissions from peripheral devices is sent after initial information transmission completion, and as when image forming apparatus control means receives this information the image forming apparatus control means starts displaying function on the operating unit based on the initial information delivered up until that time, the point in time in which transmission of initial information of all peripheral devices connected to the image forming apparatus serving as the main device is completed is made clear, the time until it is possible for a user to start operation is reduced to the lowest level possible, and the waiting time for powering on is also reduced.

Various modifications will become possible for those skilled in the art after receiving the teachings of the present disclosure without departing form the scope thereof.

What is claimed is:

1. An image forming apparatus which comprises at least one peripheral device that can be serially connected to a main body of said image forming apparatus, and communication means for performing communication with the most upstream peripheral device of said peripheral devices, and which, when turned on or reset, displays functions of said peripheral devices on an operating unit based on initial information delivered from said peripheral devices, wherein when initial information and initial information transmission completion information from said most upstream peripheral device is received, displaying of said functions on said operating unit is started based on said initial information received up until that time.

2. An image forming system, comprising:

an image forming apparatus; and a plurality of peripheral devices connected to said image forming apparatus, wherein said image forming apparatus comprises at least one peripheral device that can be serially connected to a main body of said image forming apparatus, and communication means for performing communication with the most upstream peripheral device of said peripheral devices, and when turned on or reset, displays functions of said peripheral devices on an operating unit based on initial information delivered from said peripheral devices, and when initial information and initial information transmission completion information from said most upstream peripheral device is received, starts display of said functions on said operating unit based on said initial information received up until that time.

3. The image forming system as claimed in claim 2, further comprising recognition means for at least recognizing that a peripheral device, which may be the most downstream peripheral device, is the most downstream device.

4. The image forming system as claimed in claim 3, wherein when said peripheral device recognizes itself as the most downstream device by means of said recognition means, said peripheral device transmits initial information transmission completion information to a device on the upstream side after transmitting all initial information.

5. The image forming system as claimed in claim 2, wherein when control means recognizes that a peripheral device which cannot be the most downstream peripheral device is the most downstream device, said control means determines a malfunction has occurred.

6. The image forming system as claimed in claim 2, wherein said plurality of peripheral devices are serially connected to the main body of said image forming apparatus, and communication is transmitted from said peripheral device to said main body via a peripheral device closer to said main body relative to said peripheral device.

7. The image forming system as claimed in claim 2, wherein when a peripheral device from among said peripheral devices recognizes it is not a device positioned the most downstream from said main body, said peripheral device waits to receive initial information transmission completion information from a downstream device, and when initial information transmission completion information is received from the downstream device, said peripheral device transmits initial information transmission completion information to a device on the upstream side after sending initial information regarding itself and initial information delivered from the downstream device.

8. The image forming system as claimed in claim 2, wherein when said initial information transmission completion information is not received within a time set in advance from the time when initial information is first received, control means starts display of functions on said operating unit based on information delivered up until that time.

9. The image forming system as claimed in claim 8, wherein said time set in advance can be arbitrarily set.

* * * * *